US005497647A

United States Patent [19]

Nagakura

[11] Patent Number: 5,497,647

[45] Date of Patent: Mar. 12, 1996

[54] METHOD AND AN APPARATUS FOR BENDING

[75] Inventor: Seiju Nagakura, Aichi, Japan

[73] Assignee: Toyokoki Co., Ltd., Aichi, Japan

[21] Appl. No.: 259,599

[22] Filed: Jun. 14, 1994

[30] Foreign Application Priority Data

Jul. 30, 1993 [JP] Japan ..... 5-208612

[51] Int. Cl.[6] ..... B21D 5/00

[52] U.S. Cl. ..... 72/389.3; 72/31.1; 72/702; 100/258 R

[58] Field of Search ..... 72/389, 21, 26, 72/30, 307, 414, 702, 31; 100/258 R, 258 A

[56] References Cited

U.S. PATENT DOCUMENTS

| | | | |
|---|---|---|---|
| 4,550,586 | 11/1985 | Aubert et al. | 72/389 |
| 4,640,113 | 2/1987 | Dieperink et al. | 72/389 |
| 4,802,357 | 2/1989 | Jones | 72/389 |
| 5,062,283 | 11/1991 | Miyagawa et al. | 72/389 |
| 5,148,693 | 9/1992 | Satorio et al. | 72/389 |
| 5,285,668 | 2/1994 | Tokai | 72/389 |

FOREIGN PATENT DOCUMENTS 354013 8/1991 Japan .

*Primary Examiner*—David Jones

*Attorney, Agent, or Firm*—Frank J. Jordan; Jordan and Hamburg

[57] ABSTRACT

A method and equipment for bending a work to the extent of a target bending angle, including a first process of bending to bend a work with a ram driven by a two-shaft system having a pair of right and left drive mechanisms to the extent of the quantity of motion for each shaft corresponding to the target bending angle, a measurement process to measure the bending angles at both ends of the work bent in the first process of bending, a correction process to correct the quantity of motion for each shaft according to each error between the target bending angle and the respective bending angles at both ends of the work measured in the measurement process, and a second process of bending to bend the work with the ram driven by the two-shaft system in which each shaft is actuated by each drive mechanism to the extent of the quantity of motion for each shaft corrected by the correction process, all of the above processes being performed in series.

7 Claims, 7 Drawing Sheets

METHOD AND AN APPARATUS FOR BENDING

TECHNICAL FIELD

This invention relates to a method and equipment for bending a work to the extent of a target bending angle with a ram driven by a two-shaft system having one pair of right and left drive mechanisms.

BACKGROUND ART

Conventionally, a press brake having a construction as shown in FIG. 5 has been suggested as a kind of equipment for bending processing. In said drawing, the press brake has a bed 1 and a ram 2 which are oppositely arranged at the bottom and top. The equipment has side frames 3*a*, 3*b* in parallel, at both ends of the bed 1 and integral therewith in one piece, and hydraulic cylinders 4*a*, 4*b* are provided on the top ends of the side frames 3*a*, 3*b*. The bottom ends of cylinder axes 5, 5 of the hydraulic cylinders 4*a*, 4*b* are respectively connected with the left and right shoulders of said ram 2.

A table 6 is placed on said bed 1. A lower die (not shown) is set on the table 6 and an upper die (not shown) is set beneath the bottom end of the ram 2.

Thus for the bending processing, a work is inserted into the gap between the upper die and lower die and supported on the lower die, then both hydraulic cylinders 4*a*, 4*b* are operated to lower the ram 2, so the upper die presses the work on the lower die to bend it to the extent of a target bending angle.

FIG. 6 shows an appearance of the work 7 obtained as a result of the above-mentioned bending processing.

In said drawing, the bending angles of the work 7 are indefinite along its whole length, and the bending angles θL, θR at both ends of the work 7 are different from each other. Moreover, the bending angles θL, θR are not equal to the target bending angle θ, either.

FIGS. 7 and 8 are prepared to show the factors which make the bending angles at both ends of a work different from each other.

In FIG. 7, a line C indicates the centerline of the machine and the work 7 is positioned being offset from this centerline to the right.

When the work 7 is bent under such all off-center condition, the side frame 3*b* to which the work is offset deforms larger than the other side frame 3*a* does. Because of this, the bending angles θL, θR at both ends of the work 7 fail to agree with each other.

In FIG. 8, numeral 8 shows the upper die fixed beneath the bottom of the ram 2 and numeral 9 shows the lower die fixed on the top of the bed 1. In the condition that the upper die 8 inclines to the right, the upper die 8 is fixed to the ram 2 with h1 (length of the upper die 8 projecting from the bottom end of the ram 2 at its right end) being larger than h2 (length of the upper die projecting from the bottom end of the ram at its left end).

If the die is incorrectly set like this, discrepancy arises between the bending angles θ1, θ2 at both ends of the work 7 as described above in the example shown in FIG. 7.

OBJECT OF THE INVENTION

The object of this invention is to provide a method and equipment for bending which can give a correct bending angle to a work even when the work is bent with it being offset to one side or with a die being incorrectly fixed to the equipment.

SUMMARY OF THE INVENTION

This invention is directed to a method of bending including the following processes performed in series for bending a work to the extent of a target bending angle with a ram driven by a two-shaft system having one pair of right and left drive mechanisms: a first process of bending to bend the work on trial with the ram driven by the two-shaft system in which each shaft is actuated by each drive mechanism to the extent of the quantity of motion for each shaft corresponding to the target bending angle; a measurement process to measure the bending angles at both ends of the work bent in said first process of bending; a correction process to correct the quantity of motion for each shaft according to each error between the respective bending angle measured at both ends of the work in said measurement process and the target one when the measured bending angles and target one fail to agree with each other; and a second process of bending to bend the work with the ram driven by the two-shaft system in which each shaft is actuated to the extent of the quantity of motion for each shaft corrected by said correction process.

Preferably, an operation process is performed to calculate the quantity of motion for each shaft corresponding to the target bending angle according to the conditions in bending in advance of the aforesaid first process of bending.

In accordance with the method of bending described above, a work can be bent as to the bending angles at both ends of the work to be equal to the target bending angle even when the work is offset to one side or the dies are incorrectly fixed to the equipment.

The invention includes a data input means which can determine the data concerning conditions in bending and the bending angles measured actually at both ends of the work input to said controller, and a control means which determines the quantity of motion for each shaft corresponding to the target bending angle on the basis of input data by said data input means and drives the ram to the extent of the quantity of motion by the two-shaft system in which each shaft is actuated by each drive mechanism.

According to the above-mentioned equipment for bending, a work can be bent to have a correct bending angle by the simple operation of inputting data to the controller.

BEST MODE FOR CARRYING OUT THE INVENTION

Figure 1:
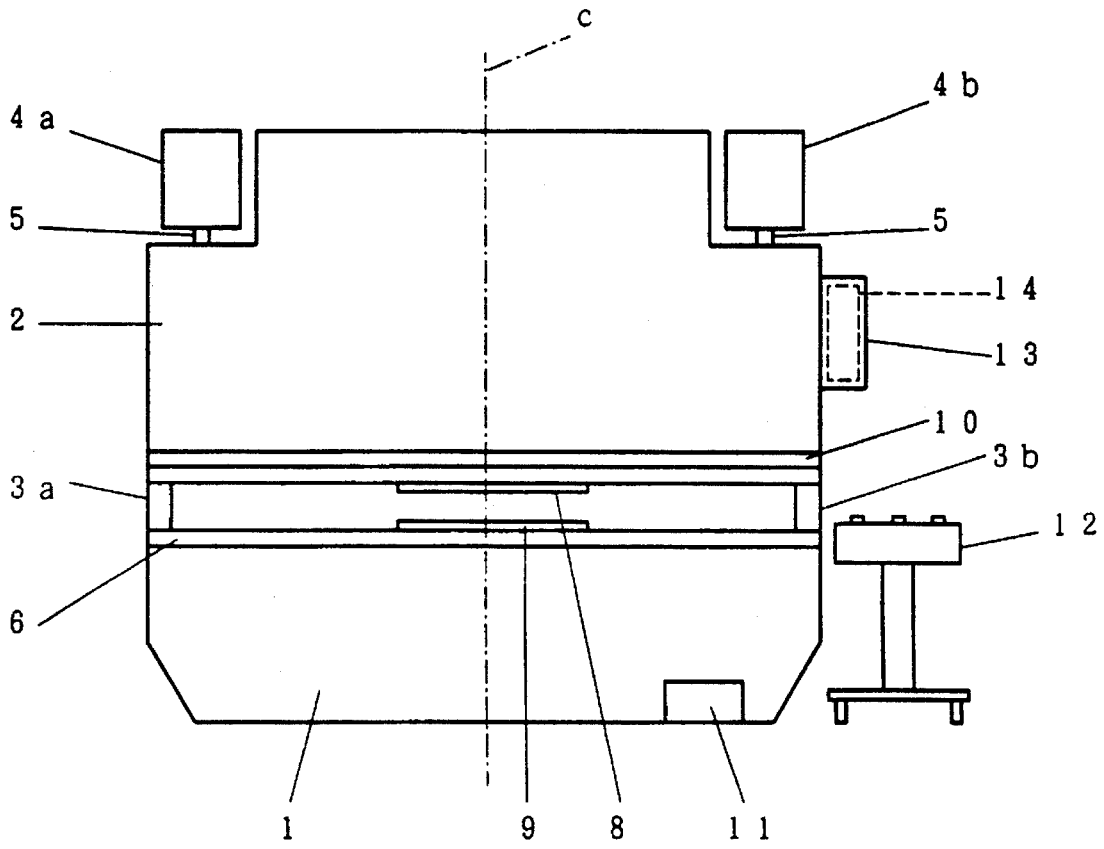
FIG. 1 is a front view showing the appearance of the press brake which is used for the method of bending of this invention.

FIG. 1 shows the appearance of the press brake to carry out the method of bending in this invention.

In said drawing, a bed 1 and a ram 2 are oppositely arranged at the bottom and the top. Side frames 3*a*, 3*b* are provided in parallel at both ends of the bed 1 and integral therewith in one piece. On the top ends of the side frames 3*a*, 3*b*, the hydraulic cylinder 4*a*, 4*b* are installed. Each hydraulic cylinder 4*a*, 4*b* independently comprised the drive mechanism. Tile bottom ends of the cylinder axes 5, 5 of the hydraulic cylinders 4*a*, 4*b* are separately connected with the right and left shoulders of the ram 2.

The drive mechanisms are not always comprised of the hydraulic cylinders 4*a*, 4*b*, but may be comprised of a pair of right and left ball screws independently driven by servo motors.

A table 6 is installed on said bed 1 and a lower die 9 is fixed on this table 6. An upper die 8 is set beneath the bottom end of the ram 2 via a holder 10.

In bending, a work is inserted into the gap between the upper die 8 and the lower die 9 and supported on the lower die 9, then a foot pedal 11 is stepped on. Thus, both hydraulic cylinders 4*a*, 4*b* are worked to lower the ram 2 and the upper die 8 presses the work on the lower die 9 to bend it.

A control box 13 is equipped at a side of the right side frame 3*b*. The control box 13 contains a controller 14, which controls mechanical operation. The controller 14 has a CPU as the main part for control and operation of data and has such memories as a RAM and ROM.

Numeral 12 is an operation board fixed on a stand supported by casters which allow the board to be moved freely. On this operation board 12, various switches including a power switch and the input and output means such as a display and a keyboard for inputting data are arranged. The operation board 12 is electrically connected to the controller 14, so various signals and input data from the operation board 12 are input to the controller 14.

Figure 2:
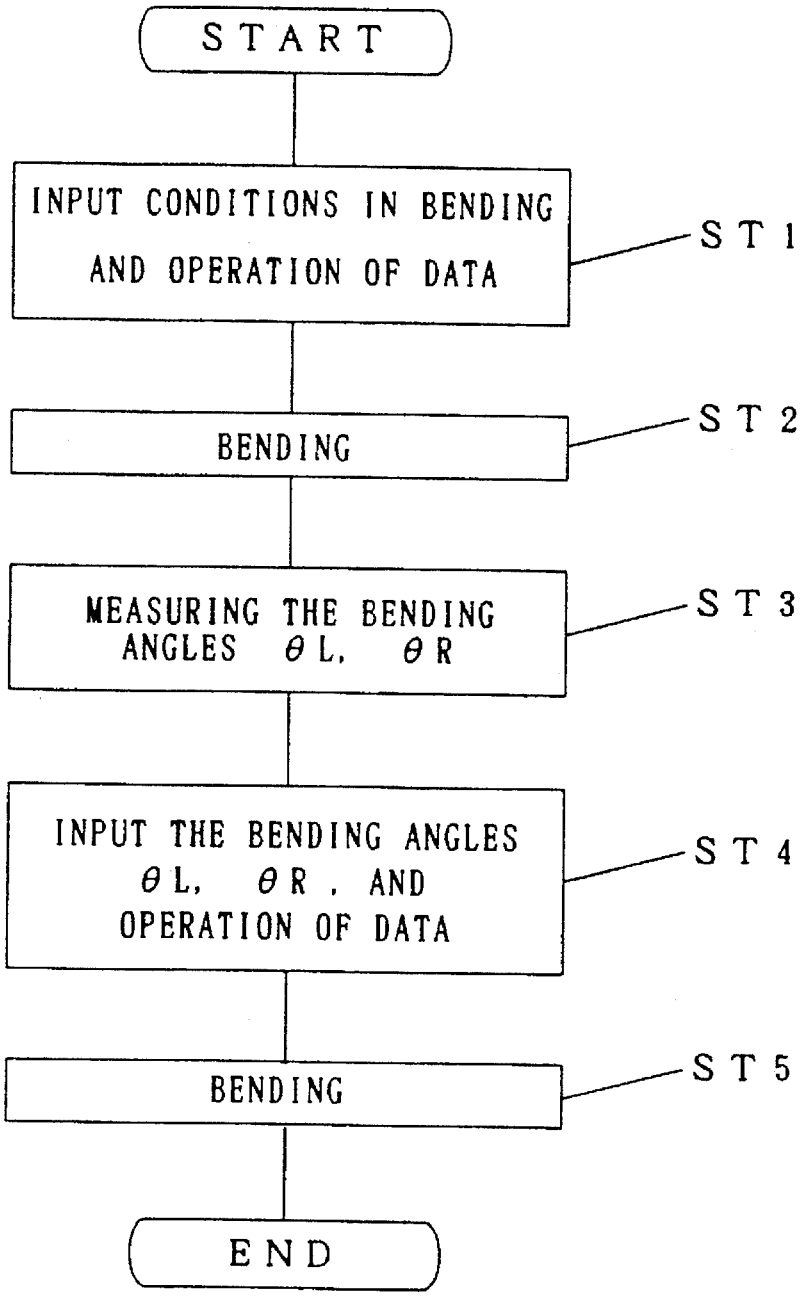
FIG. 2 is a flow chart showing a procedure of the method of bending of this invention.

In FIG. 2, the steps from 1 to 5 (indicated by ST1, ST2 and so on in FIG. 2) show the process for performing the method of bending in this invention by the press brake having the above-mentioned composition.

In the step 1, when the conditions in bending are input through the operation board 12, the controller 14 calculates the target end point of movement of the ram 2 YR, YL, as the quantity of motion for each shaft corresponding to the target bending ankle θ.

Figure 3:
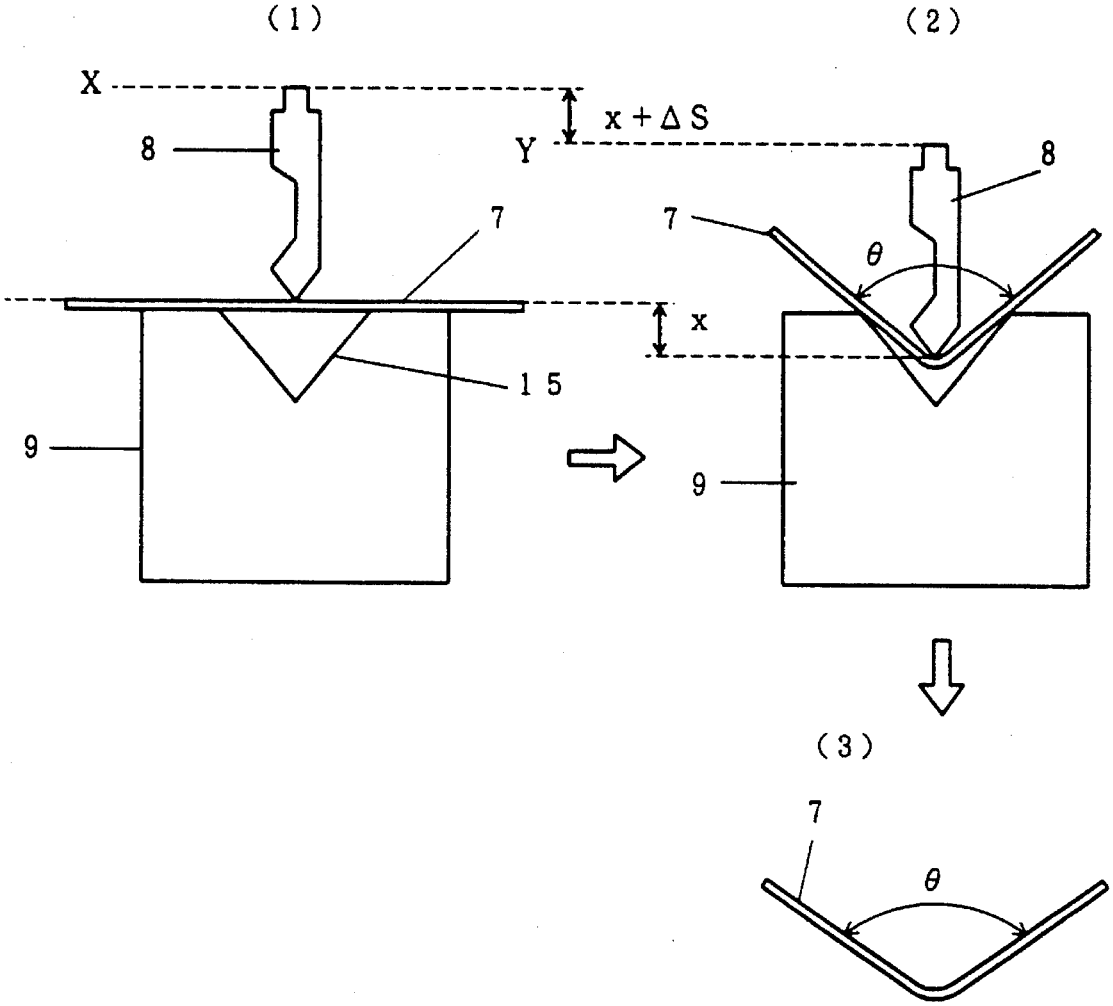
FIG. 3 is an illustration showing a relationship between a target bending angle and target movement of the upper die toward the lower die.

FIG. 3 shows the relationship between the target bending angle θ and target end point of movement Y of the upper die 8 toward the lower die 9.

In FIG. 3 (1), numeral 8 is the upper die and numeral 9 is the lower die having a V groove. The work 7 in a plate form is supported on the lower die 9. The tip of the upper die 8 contacts with the surface of the work 7. Assume the position of the ram 2 where it is lowered at this moment is X.

When the ram 2 is further lowered, the work 7 is pressed by the upper die 8 into the V groove 15 to be bent, as shown in FIG. 3 (2). As shown in FIG. 3 (3), when the work 7 is removed from the lower die 9, the bending angle θ (target bending angle) is enlarged by the spring back effect of the bent part. Therefore, the bending angle θ' of the bent work 7 in the condition shown in FIG. 3 (2) is smaller than the bending angle θ (target bending angle) in the condition shown in FIG. 3 (3).

Assume x is the pressed-in quantity of the work 7 to effect the target bending angle. Then, the pressed-in quantity x is given by the following equation (a).

$$x=f(\theta, M1, \ldots\ldots Mn, D1, \ldots\ldots Dm) \quad \text{(a)}$$

In the equation, M1~Mn are data concerning the work 7 such as tensile strength, plate thickness, and its length, and D1~Dm are data concerning the shape of the dies such as the width of V groove 15 and radius of the rounded corner. Those data and the target bending angle θ are input to the controller 14 as the conditions in bending through the keyboard of the operation board 12.

With the work 7 being pressed as shown in FIG. 3 (2), both side frames 3*a*, 3*b* yield elongation ΔS because of resiliency of the work 7. For changing the prepressing state of the work 7 as shown in FIG. 3 (1) to its pressed state as shown in FIG. 3 (2), the ram 2 is required a movement (x+ΔS). So the target end point of movement of the ram 2, Y to effect the target bending angle θ is given by the equation (b).

$$\begin{aligned} Y &= X+x+\Delta S \\ &= X+f(\theta, M1, \ldots, Mn, D1, \ldots, Dm)+\Delta S \end{aligned} \quad \text{(b)}$$

Figure 4:
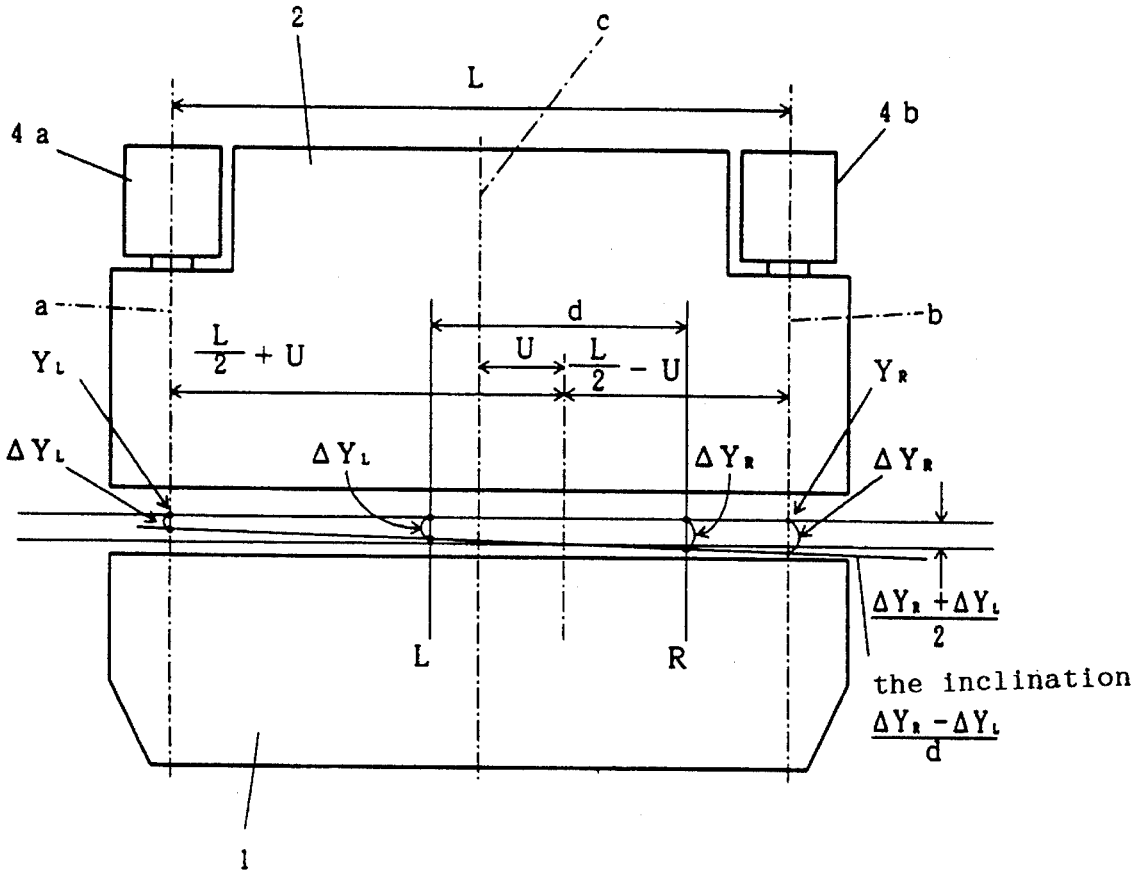
FIG. 4 is an illustration showing a correction method of the target movement.
Figure 5:
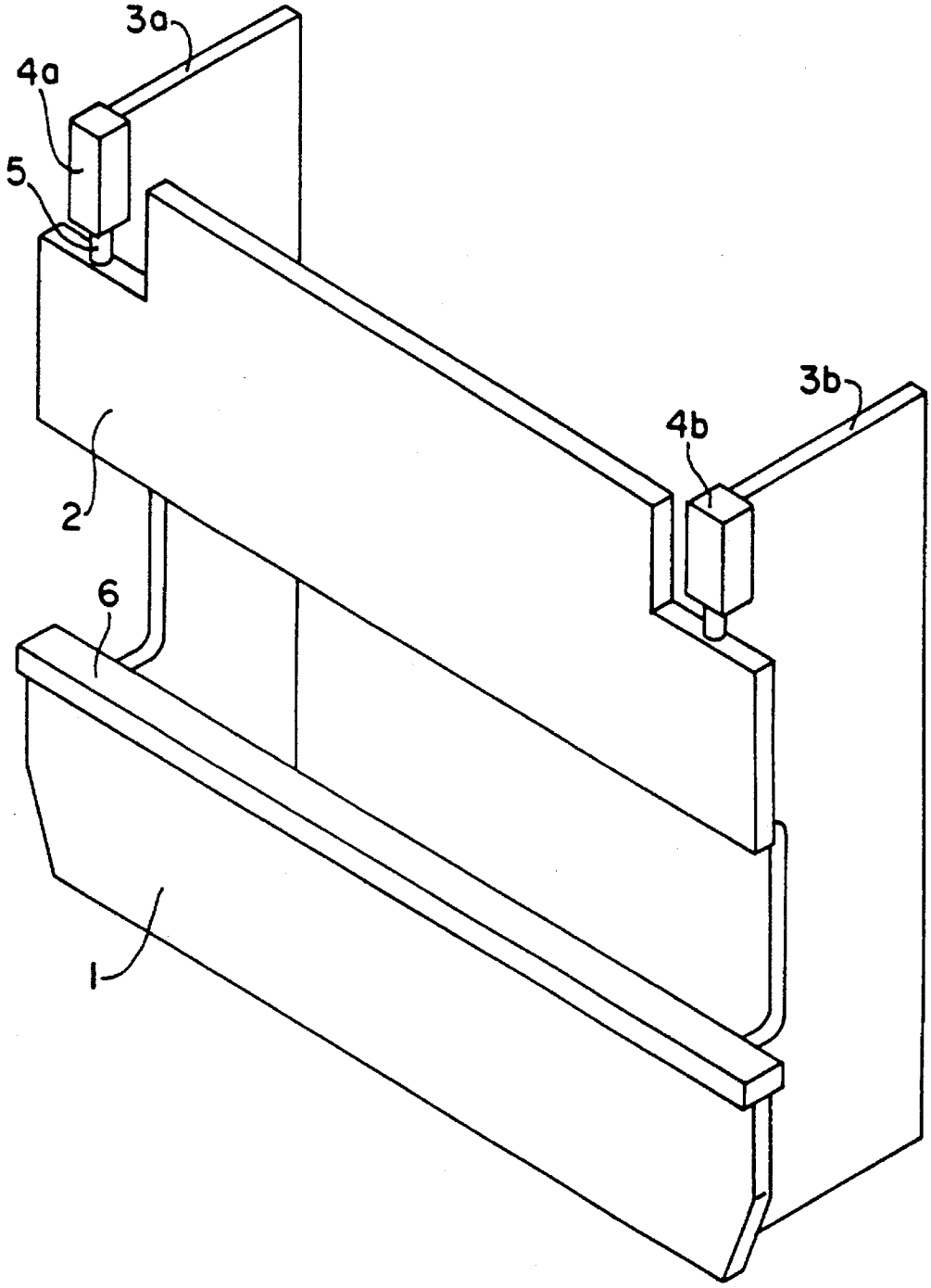
FIG. 5 is a perspective view showing the appearance of the press brake.
Figure 6:
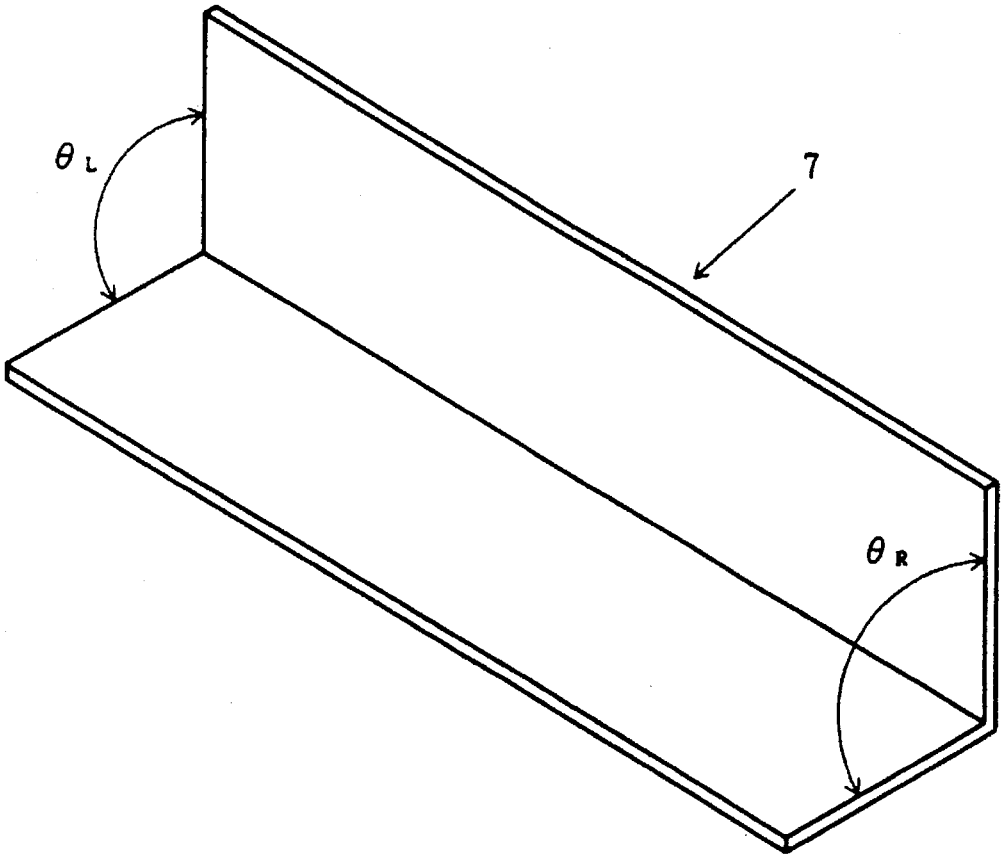
FIG. 6 is a perspective view showing the appearance of a bent work.
Figure 7:
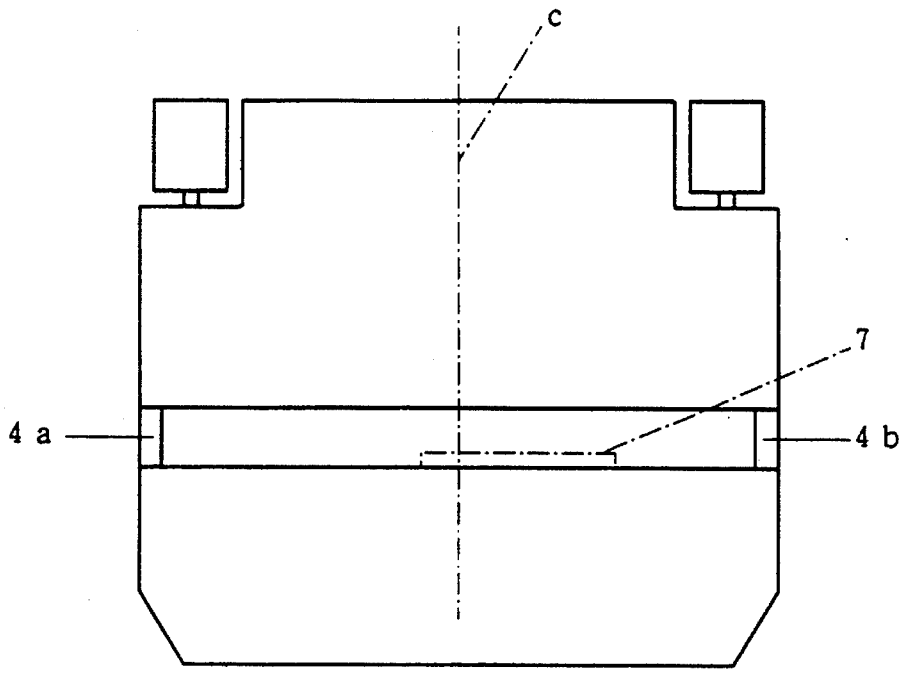
FIG. 7 is an illustration showing a factor which makes bending angles at both ends of the work fail to agree with each other.
Figure 8:
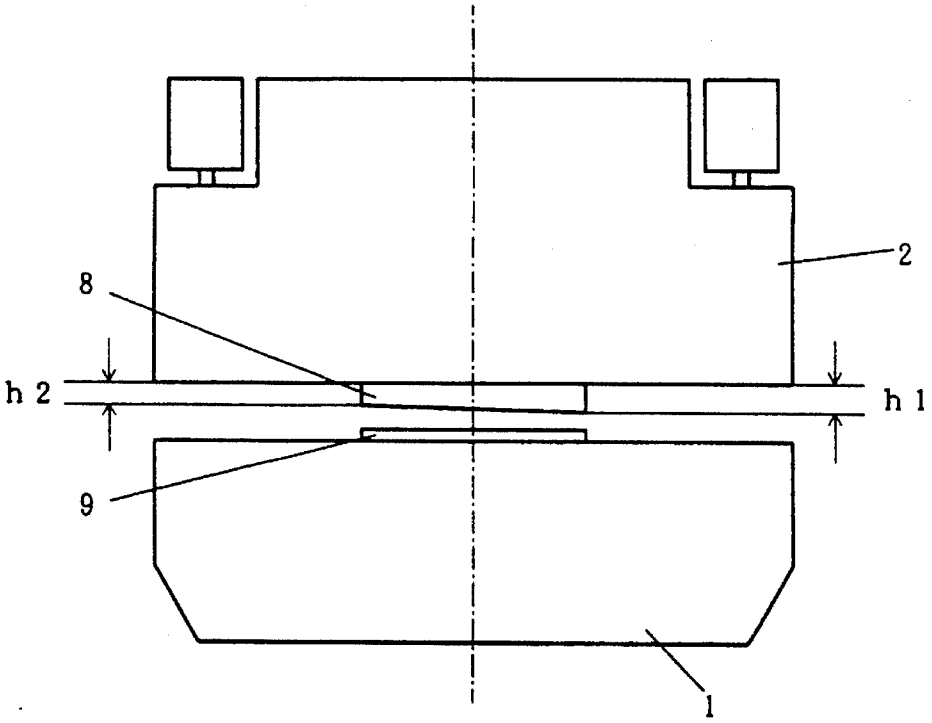
FIG. 8 is an illustration showing another factor which makes bending angles at both ends of the work fail to agree with each other.

If the work 7 is offset to the right as shown in FIG. 7, the target end point of movement of the left axis a, YL, and that of the right axis b, YR, fail to agree with each other as shown in FIG. 4. They have to be determined separately.

Assume ΔS is the deformation quantity of each side frame 3*a*, 3*b* when the work 7 is set at the center of the machine to be pressed, ρ is the resiliency of the work 7, and K is the deformation coefficient of each side frame 3*a*, 3*b*, the following equations can be obtained.

$$\Delta S = K \cdot \frac{\rho}{2} \quad \text{(c)}$$

$$K = \frac{2 \cdot \Delta S}{\rho} \quad \text{(d)}$$

In general, the left and right side frames 3*a*, 3*b* have the same, definite deformation coefficient K with no connection with any of the conditions in pressing. The following equation (e) gives the deformation quantity ΔSL of the left frame 3*a* and the equation (f) gives the deformation quantity ΔSR of the right frame 3*b*.

$$\Delta SL = K \cdot \rho \cdot \left(\frac{1}{2} - \frac{U}{L}\right) \quad \text{(e)}$$

$$\Delta SR = K \cdot \rho \cdot \left(\frac{1}{2} + \frac{U}{L}\right) \quad \text{(f)}$$

In the equations (e) and (f), U is the quantity of movement to the right of the work 7 and L is a distance between the two axes a and b. It is assumed that the quantity of movement U satisfies the condition which the following equation (g) shows. The resiliency ρ is a function of the data θ, M1~Mn, and D1~Dm concerning the conditions in bending.

$$-\frac{L}{2} \leqq U \leqq \frac{L}{2} \quad \text{(g)}$$

According to the above description, the target end point of movement of the left axis a, YL, and that of the right axis b, YR, are given by the following equations (h) and (i).

$$YL=X+f(\theta, M1, \ldots\ldots Mn, D1, \ldots, Dm)+\Delta SL \quad \text{(h)}$$

$$YR=X+f(\theta, M1, \ldots Mn, D1, \ldots, Dm)+\Delta SR \quad (i)$$

In the step 1 shown in FIG. 2, the above-mentioned conditions in bending are input through the keyboard of the operation board 12 to the controller 14 and the controller 14 calculates the target end point of movement of the left axis a, YL, and that of the right axis b, YR. Then, in the step 2, the controller 14 makes the ram 2 driven by the two-shafts system in which two shafts are actuated by the hydraulic cylinders 4*a*, 4*b* to bend the work 7.

In the succeeding step 3, the bent work 7 is removed from the equipment and the bending angles θL, θR at both ends of the work 7 are measured with a suitable measurement instrument.

As a result of the measurement, if it is found that the bending angle θL or θR fails to agree with the target bending angle θ, the bending angles θL, θR or the error angles ΔθL, ΔθR between the bending angles θL, θR and the target bending angle θ are input to the controller 14 in the succeeding step 4.

When it is assumed that the pressed-in lengths ΔYL and ΔYR of the upper die 8 respectively correspond to the error angles ΔθL, ΔθR (see FIG. 4), those pressed-in lengths are given by the following equations.

$$\Delta YL=f(\theta, \Delta\theta L, M1, \ldots Mn, D1, \ldots, Dm) \quad (j)$$

$$\Delta YR=f(\theta, \Delta\theta R, M1, \ldots Mn, D1, \ldots, Dm) \quad (k)$$

Moreover, according to the following equations, the pressed-in lengths ΔYL, ΔYR call be transformed to those of ΔYL', ΔYR' along axes of a and b.

$$\Delta YL' = \frac{\Delta YR + \Delta YL}{2} - \left(\frac{L}{2} + U\right) \cdot \frac{\Delta YR - \Delta YL}{d} \quad (l)$$

$$\Delta YR' = \frac{\Delta YR + \Delta YL}{2} - \left(\frac{L}{2} - U\right) \cdot \frac{\Delta YR - \Delta YL}{d} \quad (m)$$

In FIG. 4, it is clear that (ΔYR+ΔYL)/2 in the equations (l) and (m) indicates the pressed-in length at the center of longitudinal length of the work 7 and that (ΔYR−ΔYL)/d in both equations means the inclination of the line connecting the bottom ends of pressed-in lengths of ΔYR and ΔYL.

As a result, YL, the target end point of movement of the left axis a, and YR, the target end point of movement of the right axis b, are respectively corrected to the target end point of movements YL' and YR' which are given by the following equations.

$$YL'=X+f(\theta, M1, \ldots Mn, D1, \ldots Dm)+\Delta SL+\Delta YL' \quad (n)$$

$$YR'=X+f(\theta, M1, \ldots Mn, D1, \ldots Dm)+\Delta SR+\Delta YR' \quad (o)$$

In the step 4, when the bending angles θL, θR at both ends of the work 7 are input, the controller 14 executes the above-mentioned operation and gives the corrected target end point of movements YL', YR' for respective axes of a and b. After the completion of this correction operation, in the succeeding step 5, the controller 14 makes the ram 2 driven by the two-shaft system in which two shafts are actuated by the hydraulic cylinders 4*a*, 4*b* according to the target end points of movement YL', YR' to bend the work 7. By using this operation, the bending angles at both ends of the work 7, θL, θR, can respectively agree with target bending angle θ.

What is claimed is:

1. A method of bending a work to an extent of a target bending angle with a ram connected to a right shaft and a left shaft of a two-shaft system which are respectively driven by a a pair of right and left drive mechanisms, comprising the following steps in series:

a first step of bending the work with the ram driven by the two-shaft system in which each shaft thereof is actuated by each drive mechanism to move for a distance corresponding to the target bending angle, said first step of bending including the steps of:

providing a die having a groove of a fixed angle in opposing relation to said ram, positioning said work between said die and said ram, driving said ram by the two-shaft system such that said work is forced into said groove and bent therein, a step of measuring the bending angles at both ends of the work bent in said first step of bending;

a step of correcting the distance of movement for each shaft according to each error between the respective bending angle measured at both ends of the work in said step of measuring and the target bending angle when the measured bending angles and the target bending angle fail to agree with each other; and a second step of bending the work with the ram driven by the two-shaft system in which each shaft thereof is actuated to move for a distance corrected by said step of correcting.

2. A method of bending a work according to claim 1, further comprising the step of calculating the distance of movement for each shaft corresponding to the target bending angle according to conditions in bending, in advance of execution of said first step of bending.

3. A method of bending a work according to claim 1, wherein said groove in said die has a V-shape.

4. Equipment for bending a work to an extent of a target bending angle comprising:

a ram;

a two-shaft system having a right shaft and a left shaft connected therewith;

a pair of right and left drive mechanisms connected with said two-shaft system for moving said shafts to drive said ram;

a die having a groove of a fixed angle in opposing relation to said ram, with said work being positioned between said die and said ram;

a data input means for inputting data concerning conditions for bending and measured bending angles at both ends of the bent work; and a control means connected with said data input means for determining a distance of movement for each shaft corresponding to the target bending angle on the basis of data input by said data input means and for separately actuating each drive mechanism to separately move the respective said shaft of said two-shaft system so as to drive the ram.

5. Equipment according to claim 3, wherein said groove in said die has a V-shape.

6. Equipment according to claim 3, wherein each said drive mechanism is a cylinder having a movable piston therein, said piston forming a respective said shaft.

7. Equipment according to claim 3, wherein said control means includes means for correcting a distance of movement for each said shaft according to an error for each shaft between the respective bending angle measured at both ends of the work and the target bending angle when the measured bending angles and the target bending angle fail to agree with each other, and for separately actuating each drive mechanism to separately move the respective said shaft of said two-shaft system by said corrected distance so as to drive the ram to bend the work at said target bending angle.

* * * * *